US007441315B2

(12) United States Patent
Münstermann

(10) Patent No.: US 7,441,315 B2
(45) Date of Patent: Oct. 28, 2008

(54) NOZZLE BEAM WITH MEANS FOR SETTING WORKING WIDTH AND METHOD FOR SETTING WORKING WIDTH OF A NOZZLE STRIP

(75) Inventor: Ulrich Münstermann, Egelsbach (DE)

(73) Assignee: Fleissner GmbH, Egelsbach (DE)

( * ) Notice: Subject to any disclaimer, the term of this patent is extended or adjusted under 35 U.S.C. 154(b) by 0 days.

(21) Appl. No.: 11/795,700

(22) PCT Filed: Jan. 17, 2006

(86) PCT No.: PCT/EP2006/000345

§ 371 (c)(1),
(2), (4) Date: Jul. 19, 2007

(87) PCT Pub. No.: WO2006/081938

PCT Pub. Date: Aug. 10, 2006

(65) Prior Publication Data

US 2008/0092935 A1 Apr. 24, 2008

(30) Foreign Application Priority Data

Feb. 4, 2005 (DE) ..... 10 2005 005 463

(51) Int. Cl.
*D04H 1/46* (2006.01)
*B05B 1/14* (2006.01)

(52) U.S. Cl. ..... 28/104; 28/167

(58) Field of Classification Search ..... 28/104, 28/105, 167; 239/553, 553.3, 553.5, 566, 239/568, 597, 590, 590.3, 590.5, 600, 104
See application file for complete search history.

(56) References Cited

U.S. PATENT DOCUMENTS 3,493,462 A * 2/1970 Bunting, Jr. et al. ..... 442/405

(Continued)

FOREIGN PATENT DOCUMENTS

WO WO 03072261 A * 9/2003

*Primary Examiner*—Amy B Vanatta
(74) *Attorney, Agent, or Firm*—Andrew Wilford

(57) ABSTRACT

The nozzle beam is arranged on a device for generation of liquid streams for the treatment of fibres of a material web running along the nozzle beam. The nozzle beam comprises an upper piece (4), running across the working width of the web and a lower piece (5), which runs out into a liquid outlet slot (10). According to the invention, a nozzle strip (14) is arranged below the liquid outlet slot (10) and an easily detachable so-called masking strip (18) is mounted directly above the above in a liquid-tight manner, when viewed in the flow direction of the water jet. A part of the nozzle outlet opening on the nozzle strip is covered by the masking strip (18) and a part is left free, whereby liquid jets emerge from the part left free and form a continuous liquid curtain. According to the invention, a nozzle strip (14) with a maximum stream width is fitted to the nozzle beam. When a reduced stream width is required, a corresponding masking strip (18) is fitted which covers the non-required nozzle drillings in the outer regions of the nozzle strip (14). A simple and economical adjustment of the working width is thus possible, only that energy required for the process is used and the components guiding the material web are protected. Furthermore, the splash water flow into the plant is avoided.

4 Claims, 2 Drawing Sheets

U.S. PATENT DOCUMENTS

| | | | | | |
|---|---|---|---|---|---|
| 3,613,999 | A * | 10/1971 | Bentley et al. | ..... | 239/553.3 |
| 4,880,168 | A * | 11/1989 | Randall et al. | ..... | 239/553.5 |
| 5,054,349 | A * | 10/1991 | Vuillaume | ..... | 83/177 |
| 5,692,278 | A * | 12/1997 | Fleissner | ..... | 28/105 |
| 6,012,654 | A * | 1/2000 | Fleissner | ..... | 239/553.5 |
| 6,810,565 | B2 * | 11/2004 | Fleissner | ..... | 28/104 |
| 7,237,308 | B2 * | 7/2007 | Dixon et al. | ..... | 28/104 |
| 7,350,724 | B2 * | 4/2008 | Noelle et al. | ..... | 239/553 |
| 2004/0103506 | A1 * | 6/2004 | Fleissner | ..... | 28/104 |
| 2005/0071966 | A1 * | 4/2005 | Barth et al. | ..... | 28/104 |
| 2005/0219505 | A1 * | 10/2005 | Fleissner | ..... | 356/27 |
| 2006/0137155 | A1 * | 6/2006 | Picard et al. | ..... | 28/104 |

* cited by examiner

NOZZLE BEAM WITH MEANS FOR SETTING WORKING WIDTH AND METHOD FOR SETTING WORKING WIDTH OF A NOZZLE STRIP

CROSS REFERENCE TO RELATED APPLICATIONS

This application is the US national phase of PCT application PCT/EP2006/000345, filed 17 Jan. 2006, published 10 Aug. 2006 as WO 2006/081938, and claiming the priority of German patent application 102005005463.3 itself filed 4 Feb. 2005, whose entire disclosures are herewith incorporated by reference.

The invention relates to a nozzle beam having means for setting the working width, and a method for setting the working width of a nozzle strip.

A nozzle beam is provided on a device for generating liquid jets for the treatment of fibers of a web that is guided past the nozzle beam. The beam comprises an upper part that extends across the working width of the fiber web and a lower part secured thereto in a liquid-tight manner. A pressure chamber that is supplied with the pressurized liquid at the end, for example, is provided extending the length of the beam in the upper part. Parallel thereto and downstream from a partition a pressure-distribution chamber is provided that is connected to the pressure chamber via liquid flow holes provided in the partition, a nozzle strip containing the holes for the nozzle liquid being supported on the lower part.

The nozzle strip is used to generate water jets at a pressure of up to 1000 bar. Such a nozzle strip involves sheet metal strips approximately 1 millimeter thick and approximately 1 inch (25.4 mm) wide. The length of the nozzle strip, which extends over the entire width of the material web, is approximately 300 to 500 millimeters greater than the width of the materialweb, depending on design. The length of the nozzle strip provided with nozzles typically corresponds to the width of the material web plus 50 millimeters. The diameter of the holes in the nozzle strip is between 0.08 and 0.2 millimeters. The edge of a hole at the water inlet must be machined very precisely to ensure a clean exit of the water jet. The water jet should remain concentrated until it strikes the material web, since only in this manner can the water jet be effective with its full kinetic energy on the nonwoven fabric of the material web to be treated, and thus produce an optimal change in position of the individual fibers or filaments. As a result of this effect of change in position, the nonwoven fabric is bonded in the intended manner and optionally also influenced with regard to its structure.

Machines having the current standard working width of 3.6 meters and designed as described above have a water jet width of 3650 millimeters. For a nozzle distribution of 40 holes per inch (hpi), such a nozzle strip has a total of 5748 nozzle holes, each of which must pass a 100% functionality test. In the event of failure, a defective area on the produced goods is immediately apparent, and is either sent to rejects or at the minimum has diminished quality. These special requirements for a nozzle strip are reflected in increased production costs and correspondingly high component costs.

A production unit for treating fibers of a material web traveling past a nozzle beam must also be flexible enough in operation so that a great variety of customer orders may be processed. The goods to be produced may require many different working widths. To allow various working widths to be run on the water-jet needling machine, according to the current prior art nozzle strips having corresponding perforation widths are used. This has the disadvantage of high capital costs, since the production of nozzle strips is very expensive.

The object of the present invention is to provide a nozzle beam and a corresponding method on a device for generating liquid jets for the treatment of fibers of a material web that is traveling past the nozzle beam, which allows the working width to be set in a simple and economical manner.

The object is achieved according to the invention by a nozzle beam according to claim 1, and a corresponding method.

The nozzle beam according to the invention is mounted on a device for generating extremely fine liquid jets for hydrodynamic jet treatment of fibers of a web traveling past the nozzle beam.

The nozzle beam comprises an upper part that extends across the working width of the web, and a lower part. A pressure chamber that is supplied with the pressurized liquid is provided extending the length of the nozzle beam in the upper part. Parallel thereto in the lower part there is a pressure-distribution chamber that opens at a liquid-discharge slot. A nozzle strip is supported underneath the liquid-discharge slot, and directly thereabove, viewed in the flow direction of the water jets, an easily detachable masking strip is supported in a liquid-tight manner. A portion of the nozzle discharge holes in the nozzle strip are covered by the masking strip and a portion of the nozzle discharge holes in the nozzle strip are not covered by the masking strip. Liquid jets emerge from the nozzle discharge holes that are not covered by the masking strip and generate a dense liquid curtain.

According to the invention, a nozzle strip having a maximum jet width is provided on the nozzle beam. When a reduced jet width is required, a masking strip is mounted on upstream side of the nozzle strip, viewed in the flow direction of the water jets, which covers the unneeded nozzle holes in the outer regions of the nozzle strip.

Modification of the jet width to the working width of the material web has the additional advantage that only the quantity of energy that is required in the process is used. Otherwise, the energy consumption increases with increasing jet width. Modified jet widths also protect the components guiding the material web and reduce the occurrence of water spray in the unit, thereby reducing the process water discharge from the closed water cycle.

Advantageous embodiments are the subject matter of the subclaims.

In one preferred design, the masking strip has a slot that is shorter than the length of the row of nozzle discharge holes in the nozzle strip, the slot being positioned above the row of nozzle discharge holes in the nozzle strip in such a way that a portion of the row of nozzle discharge holes is exposed.

The masking strip is preferably made of a plastic, metal, or ceramic, or of composite materials having a rubber coating. The required shape of the masking strip may be produced by a laser cutting method, for example. The masking strip may thus be efficiently produced, and use of a nozzle beam comprising a nozzle strip and an easily replaceable masking strip ensures flexibility of the nozzle beam for various working widths in a simple and economical manner.

A further advantage is that even existing units may be retrofitted with this type of design of a nozzle beam immediately, i.e. without complicated modifications.

A nozzle beam according to the invention is explained below by way of example, with reference to the drawings that show the following:

Figure 1:
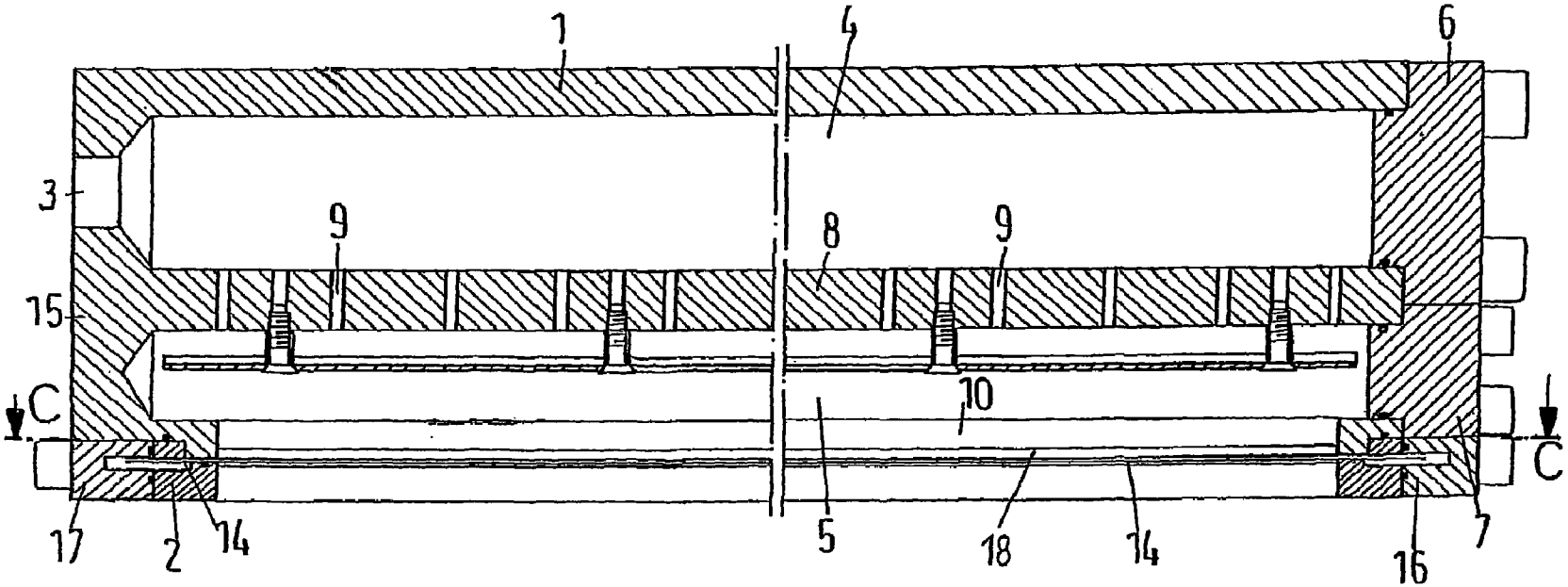
FIG. 1 is a longitudinal section through a standard nozzle beam.

The housing of the nozzle beam in FIG. 1 comprises an upper part 1 that is screwed onto a lower part 2 by numerous screws (not illustrated) attached to the underside along the length thereof. The upper part 1 has two lengthwise bores 4 and 5, the upper bore being the pressure chamber 4 and the lower bore being the pressure-distribution chamber 5. The chambers 4 and 5 are closed in a liquid-tight manner at one end by means of respective covers 6 and 7. At the other housing end 15 the pressure chamber 4 has a port 3 through which the liquid that is pressurized to up to 1000 bar is introduced. The two chambers 4 and 5 are separated from one another by a partition 8. A large number of flow holes 9 in the partition 8 connect the two chambers 4 and 5 along the length of the nozzle beam, so that liquid flowing into the pressure chamber 4 flows out over the length thereof into the pressure-distribution chamber 5 in a uniformly distributed manner. The pressure-distribution chamber 5 is open at the bottom at a liquid-discharge slot 10 that is narrow in comparison to the diameter of the bore forming the pressure-distribution chamber 5 and that extends longitudinally of the nozzle beam and a nozzle strip 14 mounted beneath the liquid-discharge slot 10. The length of the liquid-discharge slot 10 is determined by the length of the nozzle strip 14 that is not covered by a masking strip 18 directly upstream therefrom in the flow direction. The lower part 2 is closed by additional end covers 16 and 17 in a liquid-tight manner, in flush alignment with the covers 6 and 7 or the opposite housing end 15.

Figure 2:
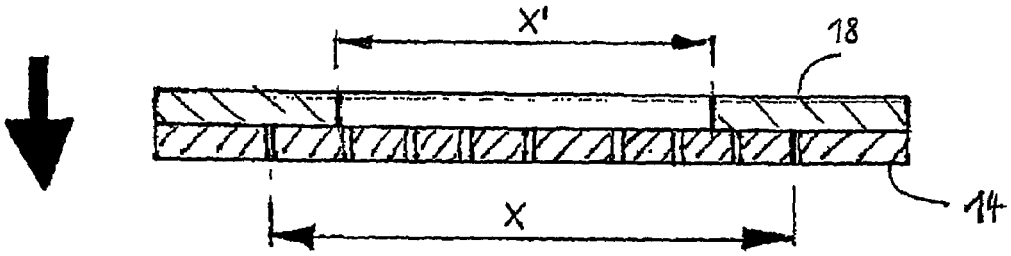
FIG. 2 is a detailed view of the nozzle strip and the masking strip from FIG. 1.

FIG. 2 is a detailed view, not true to scale, of the nozzle strip 14 and the masking strip 18 from FIG. 1. Reference letter X denotes the length of the row of perforations in the nozzle strip 14, and X' denotes the reduced length of the cutout in the masking strip 18. The vertical arrow indicates the flow direction of the water jets.

Figure 3:
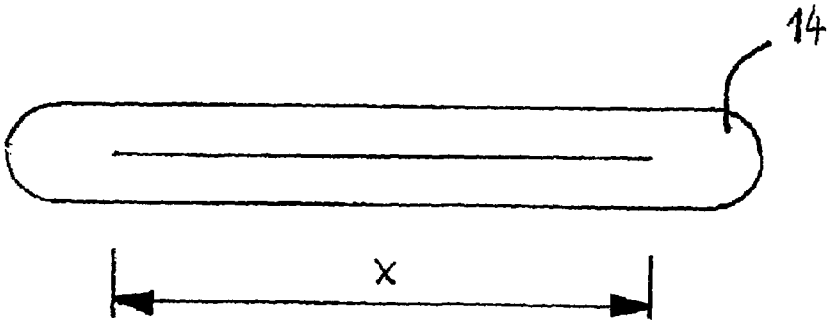
FIG. 3 is a section along line C-C according to FIG. 1, with a view of the face of the nozzle strip.

FIG. 3 is a section along line C-C according to FIG. 1, with a view of the face of the nozzle strip 14.

Figure 4:
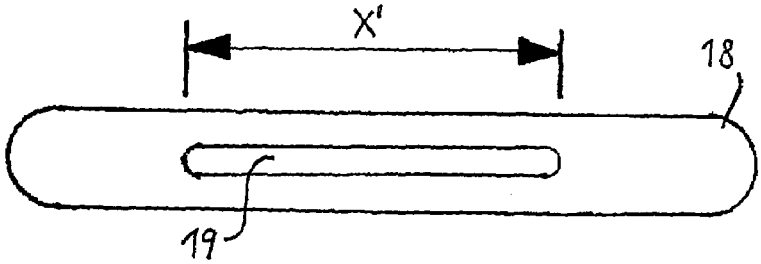
FIG. 4 is a section along line C-C according to FIG. 1, with a view of the face of the masking strip.

Similarly, FIG. 4 is a section along line C-C according to FIG. 1, with a view of the face of the masking strip 18 with its slot 19.

LIST OF REFERENCE NUMERALS

1 Upper part
2 Lower part
3 Port
4 Pressure chamber
5 Pressure-distribution chamber
6 Cover
7 Cover
8 Partition
9 Flow hole
10. Liquid-discharge slot
14 Nozzle strip
15 Housing end
16 Cover
17 Cover
18 Masking strip
19 Slot

The invention claimed is:

1. A nozzle beam having means for setting the working width of a device for generating extremely fine liquid jets for hydrodynamic jet treatment of fibers of a web traveling past the nozzle beam, the nozzle beam comprising an upper part that extends across the working width of the web and a lower part, wherein a pressure chamber that is supplied with pressurized liquid is provided extending the length of the nozzle beam in the upper part, parallel thereto in the lower part a pressure-distribution chamber is provided that opens into a liquid-discharge slot, and a detachable masking strip and a nozzle strip are supported in a liquid-tight manner underneath the liquid-discharge slot, a portion of nozzle discharge holes in the nozzle strip being covered by the masking strip and a portion of nozzle discharge holes in the nozzle strip not being covered by the masking strip, and liquid jets emerge from the nozzle discharge holes in the nozzle strip that are not covered by the masking strip and generate a dense liquid curtain.

2. The nozzle beam according to claim 1 wherein the masking strip has a slot having a length that is shorter than the length of the row of nozzle discharge holes in the nozzle strip, the slot being positioned above the row of nozzle discharge holes in the nozzle strip in such a way that a portion of the row of nozzle discharge holes is exposed along the length.

3. The nozzle beam according to claim 1 wherein the masking strip is made of a plastic, metal, or ceramic, or of composite materials having a rubber coating.

4. A method for setting the working width of a device for generating extremely fine liquid jets for hydrodynamic jet treatment of fibers of a material web traveling past the nozzle beam according to claim 1 wherein, depending on the intended working width, a corresponding masking strip is used that exposes a shorter length of the greater length of the nozzle strip perforated with nozzle discharge holes.

* * * * *